US007713619B2

(12) United States Patent
Kobayashi

(10) Patent No.: US 7,713,619 B2
(45) Date of Patent: May 11, 2010

(54) FIBER FOR DOLL HAIR AND DOLL HAIR COMPRISING THE SAME

(75) Inventor: Masaaki Kobayashi, Hyogo (JP)

(73) Assignee: Kaneka Corporation, Osaka (JP)

( * ) Notice: Subject to any disclaimer, the term of this patent is extended or adjusted under 35 U.S.C. 154(b) by 219 days.

(21) Appl. No.: 11/632,526

(22) PCT Filed: Jul. 8, 2005

(86) PCT No.: PCT/JP2005/012694

§ 371 (c)(1),
(2), (4) Date: Feb. 7, 2007

(87) PCT Pub. No.: WO2006/011350

PCT Pub. Date: Feb. 2, 2006

(65) Prior Publication Data

US 2007/0238389 A1 Oct. 11, 2007

(30) Foreign Application Priority Data

Jul. 30, 2004 (JP) ..... 2004-223597

(51) Int. Cl.
*D02G 3/00* (2006.01)

(52) U.S. Cl. ..... 428/357; 428/364; 428/394; 446/394

(58) Field of Classification Search ..... 428/357, 428/364, 394; 446/394
See application file for complete search history.

(56) References Cited

U.S. PATENT DOCUMENTS

| | | | | |
|---|---|---|---|---|
| 3,969,800 | A * | 7/1976 | Baldini et al. | 28/246 |
| 5,677,059 | A * | 10/1997 | Kakita et al. | 428/397 |
| 6,610,403 | B1 * | 8/2003 | Kasabo et al. | 428/397 |
| 6,696,156 | B2 * | 2/2004 | Kasabo et al. | 428/400 |
| 6,733,881 | B2 * | 5/2004 | Kasabo et al. | 428/364 |
| 6,821,599 | B1 * | 11/2004 | Kuroda et al. | 428/97 |
| 6,878,326 | B2 * | 4/2005 | Cho et al. | 264/210.7 |
| 7,332,563 | B2 * | 2/2008 | Masuda et al. | 528/308.1 |
| 7,501,178 | B2 * | 3/2009 | Sato | 428/364 |
| 7,501,463 | B2 * | 3/2009 | Kowaki et al. | 524/109 |
| 2003/0099830 | A1 * | 5/2003 | Cho et al. | 428/375 |
| 2006/0194050 | A1 * | 8/2006 | Van Rooy | 428/375 |
| 2007/0238389 | A1 * | 10/2007 | Kobayashi | 446/394 |
| 2008/0085957 | A1 * | 4/2008 | Masuda | 524/119 |

FOREIGN PATENT DOCUMENTS

| | | | |
|---|---|---|---|
| JP | 354131027 | A * | 10/1979 |
| JP | 6-287801 | A | 10/1994 |
| JP | 7-216678 | A | 8/1995 |
| JP | 9-67725 | A | 3/1997 |
| JP | 11-123284 | A | 5/1999 |
| JP | 11-309275 | A | 11/1999 |
| JP | 2002-285422 | A | 10/2002 |

* cited by examiner

*Primary Examiner*—N. Edwards
(74) *Attorney, Agent, or Firm*—Hamre, Schumann, Mueller & Larson, P.C.

(57) ABSTRACT

There is provided doll hair having an unprecedented curly hairstyle using a multifilament having a spiral structure with many random overlaps through a twisting step, a thermal fixing step, an untwisting step, and a thermal provisional fixing step. Specifically, the doll hair of the present invention is achieved by a multifilament processed through a twisting step, a thermal fixing step, an untwisting step, and a thermal provisional fixing step, wherein the number of twist in the twisting step is 100 to 600 times/m, the thermal fixing step is performed by treatment at 60 to 100° C. for 1 to 60 minutes, the number of twist in the untwisting step is 1.1 times or more of the number of twist in the twisting step, the thermal provisional fixing step is performed by treatment at 50° C. to 70° C. for 5 to 30 minutes in a cone or hank, and the multifilament preferably has an apparent specific gravity of 0.02 to 0.1 g/cm$^3$ and a stretching ratio of 1.0 to 15.0%.

8 Claims, No Drawings

FIBER FOR DOLL HAIR AND DOLL HAIR COMPRISING THE SAME

RELATED APPLICATION

This application is a nationalization of PCT application PCT/JP2005/012694 filed on Jul. 8, 2005 claiming priority to Japanese Application No. 2004-223597 filed on Jul. 30, 2004, the contents of which are incorporated herein by reference in their entirety.

TECHNICAL FIELD

The present invention relates to a fiber for doll hair comprising a multifilament. More particularly, the present invention relates to doll hair that has a specific wave shape by twisting processing and is bulky.

BACKGROUND ART

There are generally many doll hairstyles, and among them hairstyles with a straight or curl fiber rooted are known. As a processing method for curling hair, a method of crimping hair angularly by causing the hair to pass through a heated gear, a method of crimping hair wavily by holding the hair in a wavy heated metal plate, a method of curling hair spirally while winding the hair around a heated rod, or the like is known. However, any of the above conventional methods has drawbacks in that hair is only regularly crimped and has unnatural appearance.

Patent Document 1 describes that a straight fiber is mechanically rooted on the doll head, and then the doll hair is non-uniformly crimped by heating. However, the doll hair is not bulky. Patent Document 2 describes a technique of a fiber for doll hair in which a multifilament is twisted 20 to 200 times/m. However, this technology improves bundling properties, gloss, and feeling, and does not provide hair with a specific wave shape and bulkiness. Patent Document 3 describes a technique of doll hair composed of a fiber obtained by unraveling a knit. However, the technique employs a regular and bent fiber, and thus the doll hair has inferior natural styling properties and rooting density (covering properties) and is not bulky. Further, Patent Document 4 describes a technique of a bulky fiber for doll hair in which a multifilament is crimped by woolly processing or gear crimp processing. However, the doll hair has improved natural gloss and combing properties by finely crimping each strand, and does not have a novel curly-like hairstyle and bulkiness.

Patent Document 1: Japanese Patent Laid-Open No. 6-287801

Patent Document 2: Japanese Patent Laid-Open No. 7-216678

Patent Document 3: Japanese Patent Laid-Open No. 11-123284

Patent Document 4: Japanese Patent Laid-Open No. 11-309275

DESCRIPTION OF THE INVENTION

An object of the present invention is to provide doll hair with a bulky hairstyle having a spiral structure with many random overlaps.

As a result of extensive studies to achieve the above object, the present inventors have found that a multifilament having a spiral structure with many random overlaps can be obtained by employing a predetermined number of twist in twisting and untwisting and a predetermined thermal fixing temperature. This finding has led to the completion of the present invention.

Specifically, a first aspect of the present invention relates to a fiber for doll hair comprising a multifilament processed through a twisting step, a thermal fixing step, an untwisting step, and a thermal provisional fixing step, wherein the number of twist in the untwisting step is larger than the number of twist in the twisting step.

In a preferred embodiment, the first aspect of the present invention relates to the above-described fiber for doll hair, (1) wherein the number of twist in the twisting step is 100 times/m or more and 600 times/m or less, the treatment temperature is 60° C. or more and 100° C. or less and the treatment time is 1 minute or more and 60 minutes or less in the thermal fixing step, the number of twist in the untwisting step is 1.1 times or more of the number of twist in the twisting step, and the treatment temperature is 50° C. or more and 70° C. or less and the treatment time is 5 minutes or more and 30 minutes or less in the thermal provisional fixing step;

(2) wherein a cone is used in the thermal provisional fixing step;

(3) wherein a hank is used in the thermal provisional fixing step; or (4) wherein the multifilament has an apparent specific gravity of 0.02 g/cm$^3$ or more and 0.1 g/cm$^3$ or less and a stretching ratio of 1.0% or more and 15.0% or less.

A second aspect of the present invention relates to doll hair comprising the above-described fiber for doll hair.

According to the present invention, a multifilament is processed through a twisting step, a thermal fixing step, an untwisting step, and a thermal provisional fixing step, wherein the number of twist in the untwisting step is larger than the number of twist in the twisting step. Accordingly, a fiber for doll hair bulky and non-uniformly curled can be obtained, and an unprecedented new curly and bulky hairstyle can be provided when doll hair is produced using the fiber for doll hair.

BEST MODE FOR CARRYING OUT THE INVENTION

The present invention will be described in detail below.

The multifilament of the present invention can be composed of a known synthetic fiber, and the composition is not specifically limited. Examples of the known synthetic fiber include synthetic fibers such as a polyvinyl chloride fiber, a polyvinylidene chloride fiber, a polyamide fiber, a polyacrylonitrile fiber, a polyester fiber, a polypropylene fiber, and a polyethylene fiber. Of these, a polyvinylidene chloride fiber and a polyacrylonitrile fiber are preferable because the resulting doll hair has optimum feeling and gloss.

The fiber may have a known cross-sectional shape such as a round shape, a Y-letter shape, a C-letter shape, a triangular shape, a polygonal shape, a star-like shape, an oval shape, a flat shape, or a hollow shape, and the shape is not specifically limited.

The fineness of the multifilament may be a fineness of a fiber typically used in doll hair and is not specifically limited. The multifilament has a single yarn fineness of preferably 10 dtex or more and 100 dtex or less, and more preferably 15 dtex or more and 60 dtex or less. The multifilament preferably have a total fineness of about 200 dtex or more and 2,500 dtex or less.

The number of bundled filaments in the multifilament is not specifically limited, and about 5 to 50 filaments are typically bundled.

The multifilament of the present invention has an apparent specific gravity of preferably 0.02 g/cm$^3$ or more and 0.1 g/cm$^3$ or less, and more preferably 0.02 g/cm$^3$ or more and 0.08 g/cm$^3$ or less. If the apparent specific gravity is less than 0.02 g/cm$^3$, the multifilament is too bulky and lacks convergence, and end breakage or the like may occur in the rooting step. If the apparent specific gravity is more than 0.1 g/cm$^3$, the desired bulkiness may not be obtained.

The multifilament has a stretching ratio of preferably 1.0% or more and 15.0% or less, and more preferably 2.0% or more and 13.0% or less. If the stretching ratio is more than 15.0%, the yarn tension is difficult to be controlled and end breakage or the like may occur in the rooting step. If the stretching ratio is less than 1.0%, the desired bulkiness and stylability may not be obtained.

The multifilament is processed through a twisting step, a thermal fixing step, an untwisting step, and a thermal provisional fixing step. There are no specific limitations to the processing method. For example, an uptwister method using an Italian twisting machine or the like; a downtwister method using a pirn winder or the like; a hollow spindle method in which twisting is performed using a ring twisting machine, a double twister, or the like, and then a twisting habit is fixed using a heater; or a twisting machine to perform twisting by rubbing and then thermal fixing may be used.

In the present invention, the number of twist in the untwisting step must be larger than the number of twist in the twisting step.

The number of twist in the step of twisting the multifilament of the present invention varies depending on the type, fineness, number of doubling, and the like of the fiber. If the multifilament is excessively twisted, the resulting doll hair may have decreased gloss and feeling. Thus, the number of twist is preferably 600 times/m or less, and more preferably 500 times/m or less. If the number of twist is too small, the multifilament is highly straight, and thus the resulting doll hair may have low bulkiness. Thus, the number of twist is preferably 100 times/m or more, and more preferably 200 times/m or more.

The thermal fixing step in the present invention is performed for heating the twisted multifilament to fix the strain of the fiber and stabilize the shape. The treatment conditions in the thermal fixing step varies depending on the type, fineness, number of doubling, and the like of the fiber. The multifilament is preferably treated with dry heat or wet heat at 60° C. or more and 100° C. or less for 1 minute and more and 60 minutes or less. The multifilament is more preferably treated at 70° C. or more and 95° C. or less for about 10 minutes and more and 50 minutes or less. If the temperature is less than 60° C., the shape may not be sufficiently stable. If the temperature is more than 110° C., the multifilaments may be excessively shrunk and entangled with each other.

In the present invention, the untwisting step untwists the multifilament in the direction opposite to the twisting direction, and the thermal provisional fixing step forms a twisting habit and a reversal loop to provide many loose voids among the multifilaments. These steps can realize a spiral structure with many random overlaps. The number of twist in the untwisting step varies depending on the type, fineness, number of doubling, and the like of the fiber. The number of twist in the untwisting step must be larger than the number of twist in the twisting step, and is preferably 1.1 times or more, and more preferably 1.2 times or more of the number of twist in the twisting step. If the number of twist in the untwisting step is the number of twist in the twisting step or smaller, loose voids are not formed among the multifilaments, and the desired bulkiness cannot be achieved.

The thermal provisional fixing step is performed at a temperature lower than in the above-described twisting step so that the twisting habit by the twisting step remains, thereby providing an untwisting habit, forming many loose voids among the multifilaments, and realizing a spiral structure with many random overlaps. In the thermal provisional fixing step, treatment is preferably performed with dry heat or wet heat at 50° C. or more and 70° C. or less for 5 minute and more and 30 minutes or less, although the conditions varies depending on the type, fineness, number of doubling, and the like of the fiber. If the temperature is less than 50° C., a strong twisting habit in the twisting step remains, and thus the desired bulkiness may not be achieved. If the temperature is more than 70° C., the twisting habit in the untwisting step is stronger than the twisting habit in the twisting step, and the desired spiral structure with many random overlaps may not be realized.

A cone or hank is preferably used in the thermal provisional fixing step. An appropriate cone or hank is selected and used according to the type, fineness, number of doubling, degree of bulkiness and the like of the fiber. If the thermal provisional fixing step is performed with the multifilament wound around a cone, the multifilament is thermally provisionally fixed in a tension state, and thus the multifilament tends to have a spiral structure with many random overlaps relatively straight. On the other hand, if the thermal provisional fixing step is performed using a hank, the multifilament is thermally provisionally fixed in a relaxed state, and thus the multifilament tends to have a spiral structure with many overlaps more random and bulkier.

As described above, the fiber for doll hair of the present invention comprising a multifilament processed through a twisting step, a thermal fixing step, an untwisting step, and a thermal provisional fixing step has a spiral structure with many random overlaps. Further, the fiber for doll hair exhibits appearance completely different from a crimped or curled fiber in the prior art.

There are no specific limitations to the method for rooting the fiber for doll hair of the present invention on the doll head. The fiber may be rooted using a typical sewing machine, for example. There are also no specific limitations to the doll head. A typical doll head made of soft vinyl chloride may be used. When the fiber for doll hair of the present invention is used for doll hair, the doll hair is highly bulky. Thus, the fiber has improved covering properties in which the ground skin cannot be seen if the amount of hair is reduced. Furthermore, the fiber can provide a new hairstyle.

EXAMPLES

The present invention will be described in detail below by way of examples. However, the present invention is not limited thereto.

(Analysis Measurement Conditions and Evaluation Methods)

(A) Measurement of Apparent Specific Gravity

A processed multifilament was wound around a winder 300 times and cut into 300 fiber bundles having a length of 7 cm each, and the weight of the fiber bundles (W) was measured. Then, the fiber bundles were left at rest in a groove-like container having a length of 7 cm and a width of 3.5 cm and having a groove with both ends open. A sheet having the same dimensions as in the groove was gently placed on the container from above, and a load of 0.2 g/cm$^2$ was applied to the sheet. After one minute, the average of heights from the inner base of the groove-like container to the four corners of the lower surface of the sheet (H: cm) was measured, and the apparent specific gravity was calculated by the following formula. The test was performed three times.

$$\text{Apparent specific gravity}(g/cm^3)=W/(7\times3.5\times H)$$

(B) Measurement of Stretching Ratio

The upper end of the sample was fixed with a clamp. The sample was hanged under an initial tension of 1.7 mg/dtex and accurately marked at a position of 20 cm from the upper clamp (a). Then, a load of 90 mg/dtex was applied to the sample. 30 seconds later, the length of the sample (b) was measured. The stretching ratio was calculated by the following formula. The test was performed five times.

$$\text{Stretching ratio}(\%)=(b-a)/a\times100$$

(C) Styling

Five beauty professionals for doll hair performed beauty evaluation based on the following evaluation criteria.

Very good: The doll hair is highly bulky and realistically styled.

Good: The doll hair is bulky and moderately styled.

Fair: The doll hair is bulky but styled only with difficulty.

Poor: The doll hair is poorly bulky and styled only with difficulty.

(D) Feeling

Five professionals for judging feeling of doll hair performed sensory evaluation based on the following evaluation criteria. Such evaluation was performed based on comparison with the feeling of doll hair obtained in Comparative Example 1.

Very good: The feeling of the doll hair is much softer and much more natural than that of the doll hair of Comparative Example 1.

Good: The feeling of the doll hair is slightly softer than that of the doll hair of Comparative Example 1.

Fair: The feeling of the doll hair is as rough as that of the doll hair of Comparative Example 1.

Poor: The feeling of the doll hair is rougher than that of the doll hair of Comparative Example 1.

(E) Overall Evaluation

Five beauty professionals for doll hair performed the following overall evaluation on a scale of 1 to 5. Doll hair of 4 points or higher was acceptable.

Evaluation Criteria

5: Very good; 4: Good; 3: Fair; 2: Poor; 1: Very poor

Production Example 1

An acrylonitrile copolymer composed of 49 wt % of acrylonitrile, 50 wt % of vinyl chloride, and 1 wt % of sodium styrenesulfonate was dissolved in acetone to prepare a spinning solution, and the spinning solution was spun. After drying and drawing steps, a multifilament having a fineness of 792 dtex was obtained in which 36 filaments having a single yarn fineness of 22 dtex each were gathered.

Example 1

The multifilament obtained in Production Example 1 was wound around a cone while being twisted 480 times/m, and steam set at 80° C. for 20 minutes. The resulting twist yarn was sufficiently cooled to room temperature. Then, the twist yarn was wound around a cone while being twisted in the untwisting direction 580 times/m, steam set at 55° C. for 20 minutes, and sufficiently cooled. The resulting multifilament had an apparent specific gravity of 0.057 g/cm$^3$ and a stretching ratio of 3.0%. Next, the resulting multifilament was rooted on the doll head made of soft vinyl chloride using a rooting sewing machine for doll to prepare doll hair. Unprecedented doll hair was obtained which had a spiral structure with many overlaps, was bulky, and exhibited excellent texture. The results are shown in Table 1.

TABLE 1

| | Total fineness (d) | Apparent specific gravity (g/cm$^3$) | Stretching ratio (%) | Styling | Feeling | Overall evaluation |
|---|---|---|---|---|---|---|
| Example 1 | 792 | 0.057 | 3.0 | Good | Very good | 4 |
| Example 2 | 2376 | 0.057 | 2.2 | Good | Very good | 4 |
| Example 3 | 792 | 0.030 | 9.4 | Very good | Very good | 5 |
| Example 4 | 2376 | 0.042 | 3.6 | Very good | Very good | 5 |
| Comparative Example 1 | 792 | 0.148 | 1.1 | Poor | — | 2 |
| Comparative Example 2 | 792 | 0.059 | 32.4 | Fair | Poor | 2 |

Example 2

Three multifilaments obtained in Production Example 1 were doubled to prepare a fiber having a fineness of 2,376 dtex. The fiber was wound around a cone while being twisted 250 times/m, and steam set at 85° C. for 40 minutes. The resulting twist yarn was sufficiently cooled to room temperature. Then, the twist yarn was wound around a cone while being twisted in the untwisting direction 350 times/m, steam set at 55° C. for 20 minutes, and sufficiently cooled. The resulting multifilament had an apparent specific gravity of 0.057 g/cm$^3$ and a stretching ratio of 2.2%. Then, doll hair was prepared in the same manner as in Example 1. Unprecedented doll hair was obtained which had a spiral structure with many overlaps, was bulky, and exhibited excellent texture. The results are shown in Table 1.

Example 3

The multifilament obtained in Production Example 1 was wound around a cone while being twisted 480 times/m, and steam set at 80° C. for 20 minutes. The resulting twist yarn was sufficiently cooled to room temperature. Then, the twist yarn was hanked while being twisted in the untwisting direction 580 times/m, steam set at 55° C. for 20 minutes, and sufficiently cooled. The resulting multifilament had an apparent specific gravity of 0.03 g/cm$^3$ and a stretching ratio of 9.4%. Then, doll hair was prepared in the same manner as in Example 1. Unprecedented doll hair was obtained which had a spiral structure with many overlaps, was bulkier than in Example 1, and exhibited excellent texture. The results are shown in Table 1.

Example 4

Three multifilaments obtained in Production Example 1 were doubled to prepare a fiber having a fineness of 2,376 dtex. The fiber was wound around a cone while being twisted 250 times/m, and steam set at 85° C. for 40 minutes. The resulting twist yarn was sufficiently cooled to room temperature. Then, the twist yarn was hanked while being twisted in the untwisting direction 350 times/m, steam set at 55° C. for 20 minutes, and sufficiently cooled. The resulting multifilament had an apparent specific gravity of 0.042 g/cm$^3$ and a stretching ratio of 3.6%. Then, doll hair was prepared in the same manner as in Example 1. Unprecedented doll hair was obtained which had a spiral structure with many overlaps, was bulkier than in Example 2, and exhibited excellent texture. The results are shown in Table 1.

Comparative Example 1

The multifilament obtained in Production Example 1 was wound around a cone while being twisted 480 times/m, and steam set at 80° C. for 20 minutes.

The resulting twist yarn was sufficiently cooled to room temperature. Then, the twist yarn was hanked while being twisted in the untwisting direction 480 times/m, steam set at 50° C. for 20 minutes, and sufficiently cooled. The resulting multifilament had an apparent specific gravity of 0.148 g/cm$^3$ and a stretching ratio of 1.1%.

Then, doll hair was prepared in the same manner as in Example 1. The resulting filaments provided poorly bulky doll hair having appearance of slightly wavy twist yarn. The results are shown in Table 1.

Comparative Example 2

The multifilament obtained in Production Example 1 was knitted using a round knitting machine having a cylinder with a diameter of 3.75 inch and 90 needles to obtain an 8-course and 10-wale knitted fabric. The knitted fabric was steam set at 98° C. for 10 minutes and then dried with dry heat at 60° C. for 30 minutes. Then, the knitted fabric was wound around a cone while being unknitted. The resulting multifilament had an apparent specific gravity of 0.059 g/cm$^3$ and a stretching ratio of 32.4%. Then, doll hair was prepared in the same manner as in Example 1. The resulting knit-deknit filaments were highly bulky, but provided spring-like and highly stretchy doll hair and exhibited poor feeling and appearance. The results are shown in Table 1. As is clear from Table 1, doll hair exhibiting excellent styling and feeling was obtained in Examples 1 to 4.

INDUSTRIAL APPLICABILITY

According to the present invention, a fiber for doll hair bulky and non-uniformly curled can be obtained, and an unprecedented new curly and bulky hairstyle can be provided when doll hair is produced using the fiber for doll hair.

The invention claimed is:

1. A multifilament for doll hair, the multifilament having been processed through a twisting step, a thermal fixing step, an untwisting step, and a thermal provisional fixing step, wherein a number of twist in the untwisting step is larger than a number of twist in the twisting step, so that the multifilament exhibits a stretching ratio of 2.0% to 13.0%, the stretching ratio being determined by: fixing an upper end of the multifilament with a clamp; hanging the multifilament under an initial tension of 1.7 mg/dtex; marking the multifilament at a position of 20 cm from an upper clamp (a); applying a load of 90 mg/dtex to the multifilament; 30 seconds later, measuring a length of the multifilament (b); and calculating the stretching ratio by a following formula:

$$\text{Stretching ratio}(\%)=\{(b-a)/a\}\times 100.$$

2. The multifilament for doll hair according to claim 1, wherein the number of twist in the twisting step is 100 times/m to 600 times/m, the treatment temperature is 60° C. to 100° C. and the treatment time is 1 minute to and 60 minutes in the thermal fixing step, the number of twist in the untwisting step is 1.1 times or more of the number of twist in the twisting step, and the treatment temperature is 50° C. to 70° C. and the treatment time is 5 minutes to 30 minutes in the thermal provisional fixing step.

3. The multifilament for doll hair according to claim 1, wherein a cone is used in the thermal provisional fixing step.

4. The multifilament for doll hair according to claim 1, wherein a hank is used in the thermal provisional fixing step.

5. The multifilament for doll hair according to claim 1, wherein the multifilament has an apparent specific gravity of 0.02 g/cm$^3$ to 0.1 g/cm$^3$.

6. Doll hair comprising the multifilament for doll hair according to any one of claims 1 to 5.

7. The multifilament for doll hair according to claim 1, wherein the multifilament having a spiral structure with many random overlaps.

8. The multifilament for doll hair according to claim 1, wherein the multifilament has a single yarn fineness of 10 dtex to 100 dtex and a total fineness of 200 dtex to 2,500 dtex.

* * * * *